US006318660B1

(12) United States Patent
Bordignon et al.

(10) Patent No.: US 6,318,660 B1
(45) Date of Patent: Nov. 20, 2001

(54) COILING MACHINE FOR ROLLED STOCK

(75) Inventors: Giuseppe Bordignon, Bicinicco; Andrea De Luca, Remanzacco; Alfredo Poloni, Fogliano di Redipuglia, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/432,153

(22) Filed: Nov. 2, 1999

(30) Foreign Application Priority Data

Nov. 4, 1998 (IT) ..... UD9800190

(51) Int. Cl.[7] ..... B21C 74/24; B65H 54/56

(52) U.S. Cl. ..... 242/362.2; 242/472.5; 242/476.1

(58) Field of Search ..... 242/362.2, 362.3, 242/363, 472.5, 476.1

(56) References Cited

U.S. PATENT DOCUMENTS

| | | | | |
|---|---|---|---|---|
| 1,660,608 | * | 2/1928 | Flynn | 242/362.3 |
| 2,529,185 | * | 11/1950 | Proctor | 242/573.9 |
| 2,789,775 | * | 4/1957 | Thompson | 242/472.5 |
| 3,945,585 | | 3/1976 | Moslener . | |
| 4,664,329 | | 5/1987 | Pali . | |
| 4,674,701 | * | 6/1987 | Dreher et al. | 242/574.4 |
| 5,465,922 | * | 11/1995 | Vander Groef | 242/573 |
| 5,769,342 | * | 6/1998 | Makitka | 242/571 |
| 5,772,151 | * | 6/1998 | Teng | 242/573 |

FOREIGN PATENT DOCUMENTS

| | | | | |
|---|---|---|---|---|
| 1265525 | | 4/1968 | (DE) . | |
| 3150319 | | 6/1983 | (DE) . | |
| 3404893 | | 8/1985 | (DE) . | |
| 0 147 711 | * | 7/1985 | (EP) | 242/573.9 |

* cited by examiner

*Primary Examiner*—Michael R. Mansen
(74) *Attorney, Agent, or Firm*—Stevens, Davis, Miller & Mosher, LLP

(57) ABSTRACT

Coiling machine for rolled stock located downstream of a rolling train, including a mandrel mounted rotatably around an axis or rotation on a stationary structure, the mandrel being mounted cantilevered on the stationary structure and including an inner wall orthogonal to the axis or rotation and an outer end with which a cylindrical plate is suitable to selectively cooperate, the cylindrical plate being movable from a working position, where it is arranged substantially orthorgonal to the axis of rotation so as to define a side wall parallel to the inner wall, to allow the coil of rolled stock to form and an inactive position wherein it is distanced and lowered with respect to the mandrel so as to allow the coil of rolled stock to be axially removed.

16 Claims, 3 Drawing Sheets

COILING MACHINE FOR ROLLED STOCK

FIELD OF THE INVENTION

This invention concerns a coiling machine for rolled stock, particularly bars, plate, or rods (smooth or ribbed) of hot-rolled metal material, with a cross-section either round, square, rectangular, hexagonal or otherwise.

To be more exact, the invention concerns a coiling machine located downstream of a traditional rolling train, equipped with drawing rollers and shears, wherein the rolled stock is wound into spirals to form coils which are subsequently tied to be stored or moved.

BACKGROUND OF THE INVENTION

Coiling machines which are known to the state of the art are substantially divided into two categories, according to whether the axis of rotation of the mandrel or reel is vertical or horizontal.

Coiling machines with a vertical axis of rotation are based mainly on coiling inside containing cylinders, where the spirals are formed with the help of spiral-forming tools equipped with relative motion with respect to the containing cylinder.

This type of coiling machine generally does not ensure that a compact coil is formed, since the reciprocal movement of the spiral-forming tool and the containing cylinder is quite uncontrolled and since the stock which is being coiled is not subjected to a controlled tension.

Coiling machines with a horizontal axis of rotation normally allow to obtain much more compact coils, since the product to be coiled is wound on the central mandrel, which is made to rotate by a motor organ. In such coiling machines, the coil is made by means of successive, superimposed rings or layers, which are coaxial to the reel, and thus compact coils are obtained.

The state of the art includes a coiling machine wherein a curved element is arranged inside a containing cylinder, in which the spirals are formed and accumulate, and is kept substantially parallel to the inner surface of the containing cylinder.

In this coiling machine, while the containing cylinder is made to rotate, the curved element is made to gradually advance, parallel to the axis of rotation of the cylinder, and is removed from inside the coil when the latter has been completed.

Although this coiling machine is equipped with a device which facilitates the formation of the spirals of the coil, it does not ensure that a compact coil is formed, since the reciprocal movement of the spiral-forming tool and the containing cylinder is quite uncontrolled and since the stock which is being coiled is not subjected to a controlled tension.

The state of the art also includes a coiling machine located at the end of a rolling plant for the continuous production of iron bars, wire or round pieces, wherein a single plane product, obtained during a first rolling step, is sub-divided into a plurality of profiles which are given the desired shape in subsequent rolling operations. In this plant the rolled products thus obtained are conveyed, parallel to each other, towards the stationary coiling machine with a horizontal axis of rotation, which provides to coil them simultaneously, or in parallel, so as to form a plurality of coils on the same mandrel.

This coiling machine has the disadvantage that several profiles, which may even be different from each other, are wound onto the same mandrel, rotating at a set angular velocity, and therefore the coil formed is neither compact nor in the least controlled while it is being formed.

Moreover, coiling machines which are known to the state of the art do not guarantee a uniform temperature over the whole stock which has been rolled and coiled, with differences at the leading and trailing end and the centre; this gives a lack of uniformity of the metallurgical aspect over the whole coil of rolled stock.

The present applicant has designed, tested and embodied this invention to overcome the shortcomings of the state of the art and to obtain further advantages.

SUMMARY OF THE INVENTION

The coiling machine according to this invention is set forth and characterised in the main claim, while the dependent claims describe other characteristics of the main embodiment.

The main purpose of the invention is to achieve a precision coiling machine, that is to say of the type in which the individual spirals are formed under the guidance of mechanical means which regulate their packing, their density and their tension, and wherein it is very easy and quick to remove the coil of rolled stock as soon as it has been formed.

In accordance with this purpose, the coiling machine according to the invention comprises a mandrel mounted rotatable and cantilevered, around its axis of rotation, on a stationary structure; the mandrel comprises an inner wall orthogonal to the axis of rotation and has an outer end with which a cylindrical plate is suitable to cooperate selectively; the latter is movable from a working position, wherein it is arranged substantially orthogonal to the axis of rotation so as to define a lateral wall parallel to the inner wall, so as to allow the coil of rolled stock to form, and an inactive position, wherein it is distanced and lowered with respect to the mandrel so as to allow the coil of rolled stock to be axially removed.

The coiling machine according to the invention is suitable to coil hot rolled stock of any type, such as bars, plate, or rods (smooth or ribbed) of metallic material, such as low, medium or high carbon steels, stainless steels, alloys or otherwise, with a cross section which may be round, square, rectangular, hexagonal or otherwise, with diameters of between 8 and 52 mm or, in the case of bars or plate, with a section of between 60 $mm^2$ ( for example 20 mm by 3 mm) and 1400 $mm^2$ (for example 70 mm by 20 mm).

It is thus possible to coil rolled stock travelling at speeds of up to 40 meters per second and more, with a very high hourly production, in the order of about 100–110 tonnes per hour.

Another purpose of the invention is to provide a coiling machine which will facilitate the formation of the first spirals of rolled stock to be coiled around the reel.

Another purpose of the invention is to achieve a coiling machine wherein, for each coiling machine, means are provided to maintain the coil uniformly compact, so as to guarantee uniformity of temperature and of metallurgical features over the whole rolled and coiled stock, without appreciable differences between the leading end, the centre, and the trailing end thereof.

BRIEF DESCRIPTION OF THE DRAWINGS

These and other characteristics of the invention will become clear from the following description of a preferred form of embodiment, given as a non-restrictive example, wherein.

DETAILED DESCRIPTION OF PREFERRED EMBODIMENT

Figure 1:
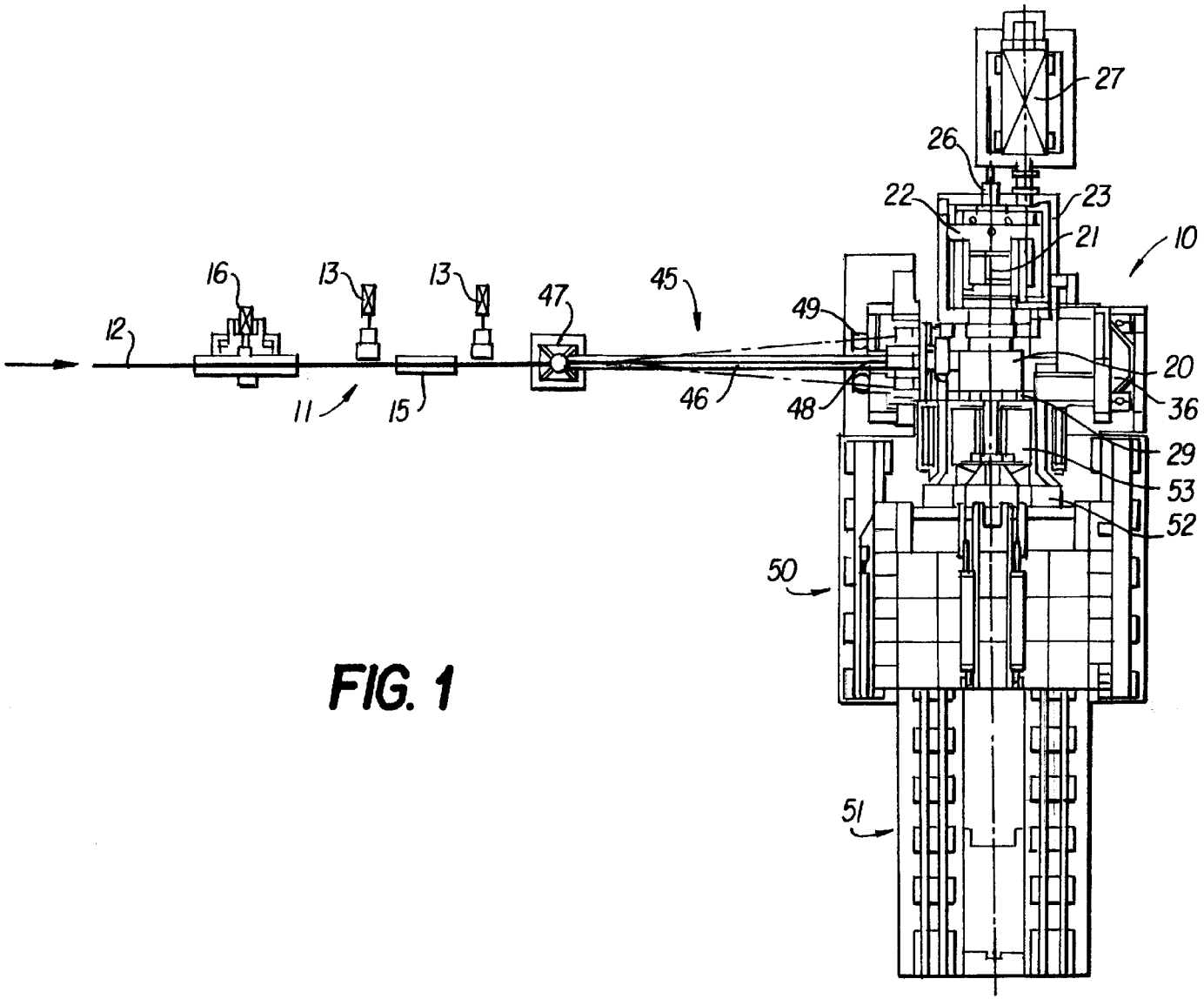
FIG. 1 is a view from above, in diagram form, of a coiling line using a coiling machine according to the invention.

With reference to FIG. 1, a coiling machine 10 according to the invention is suitable to be arranged downstream of a rolling train 11 to coil the rolled stock 12 emerging therefrom.

The rolling train 11 can be of any known type, comprising drawing rollers 13, a loop-forming device 15 and a shears 16 which is suitable to shear to size the rolled stock 12 to be coiled.

The looper 15 is suitable to regulate the flow of rolled stock 12 towards the coiling machine 10 and to make it correctly perform the increase in diameter step, during the same coiling operation. The looper 15 thus fulfills a function of a buffer for the rolled stock 12 before it is coiled.

Figure 3:
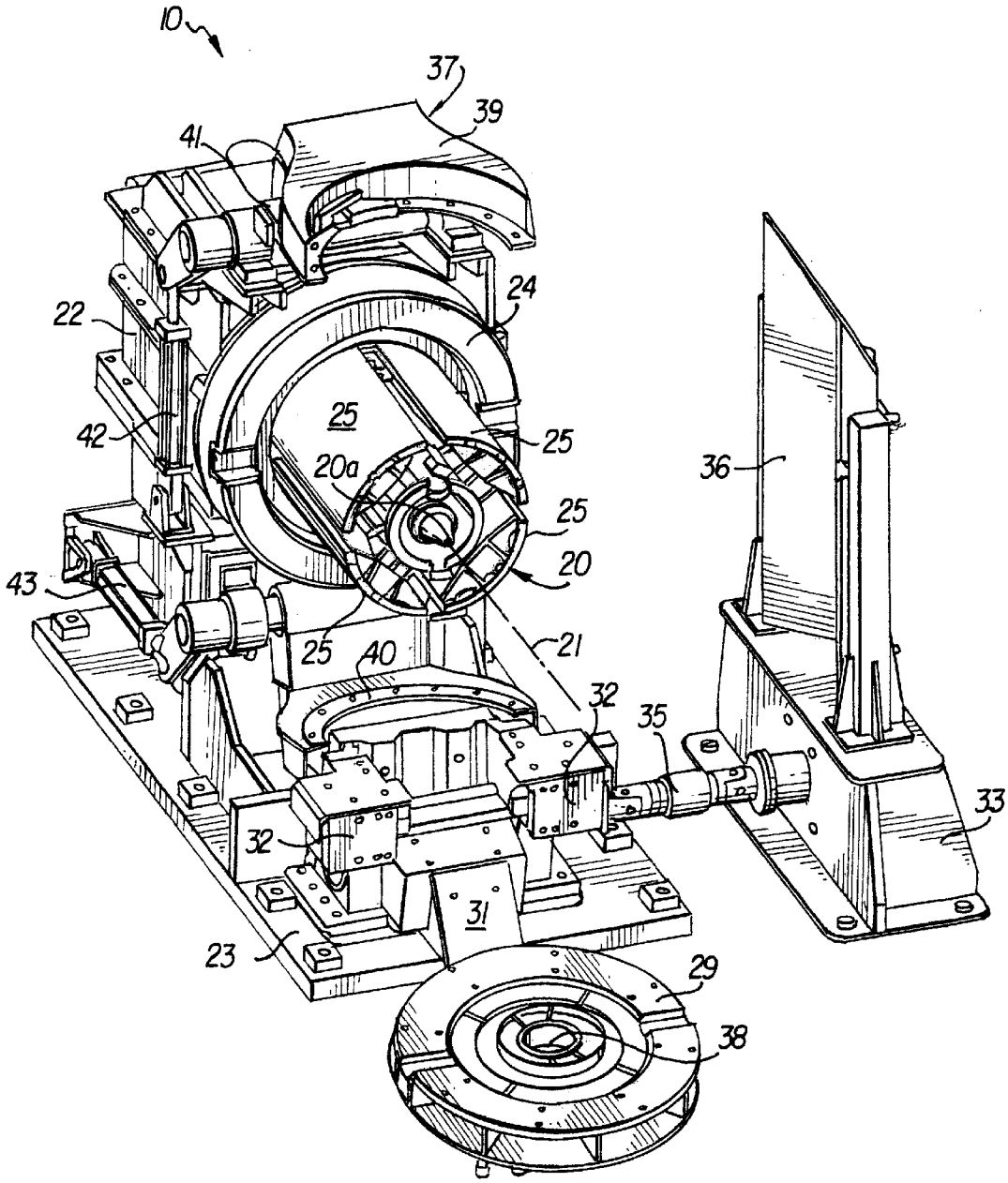
FIG. 3 is a prospective view of the coiling machine according to the invention, in an inactive position or a position wherein the coil is removed.

The coiling machine 10 comprises a mandrel or reel 20 with a horizontal axis of rotation 21 (FIG. 3), mounted cantilevered and rotatable on a vertical turret 22 of a stationary metallic structure 23.

The mandrel 20 comprises four elements 25 arranged radially at 90° with respect to each other so as to form a cylindrical surface; the four elements 25 are retractable radially so as to facilitate the removal of the just-formed coil of rolled stock 12. The radial movement of the four elements 25 is obtained with a hydraulically commanded and water cooled mechanism 26.

The inner part of the mandrel 20 comprises a cylindrical wall 24, orthogonal to the axis of rotation 21, which defines one of the lateral walls between which the coil of rolled stock 12 is formed.

The mandrel 20 is made to rotate selectively around the axis 21, by an electric motor 27 (FIG. 1), by means of a reduction unit which is arranged inside the turret 22 and which has special gears with helical teeth with a suitable ratio for high speeds.

A cylindrical containing plate 29 is suitable to cooperate with the outer end of the mandrel 20; the cylindrical plate 29 is mounted rotatable and cantilevered on one end 30 of an arm 31, the other end of which pivots on two blocks 32 of the stationary structure 23.

The outer end 20*a* of the mandrel 20 is conical in shape and is suitable to be inserted in a corresponding central seating 38, also conical, of the plate 29, so as to achieve a coupling between the mandrel 20 and plate 29.

Figure 2:
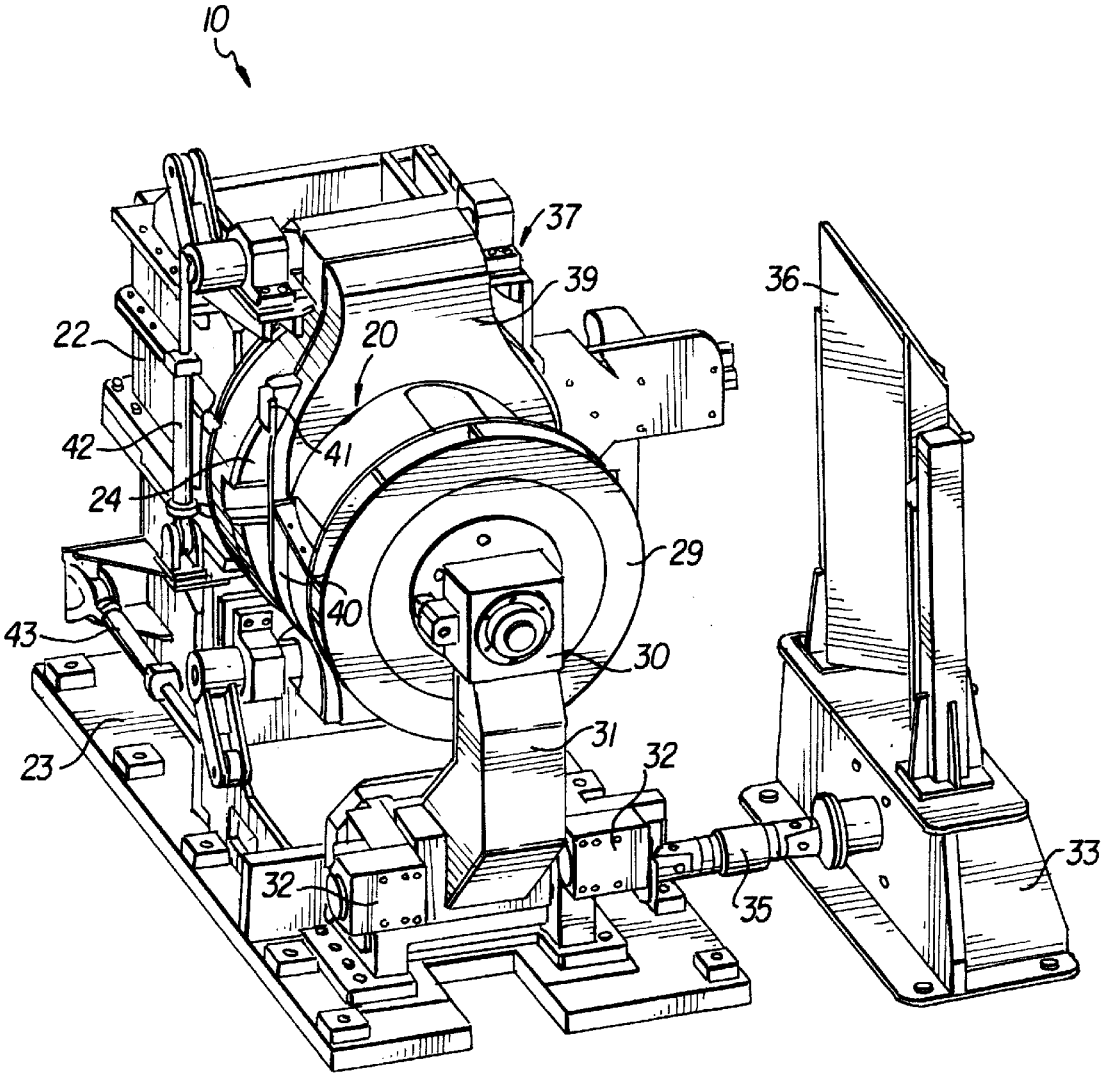
FIG. 2 is a prospective view of the coiling machine according to the invention, in a working position.

The cylindrical plate 29 can move between a working position (FIG. 2), wherein it is arranged substantially orthogonal to the axis of rotation 21 of the mandrel 20 and cooperating therewith so as to define the second lateral wall between which the coil of rolled stock 12 is formed, and an inactive position, or position wherein the coil is removed (FIG. 3), wherein it is distanced and lowered with respect to the mandrel 20 and arranged substantially horizontal.

In order to take the plate 29 from the working position to the inactive position and vice versa, a command is given by an actuation organ 33 by means of a transmission shaft 35.

On the upper part of the command organ 33 a protective screen 36 is mounted.

The coiling machine 10 also comprises a device 37 suitable to facilitate the formation of the first spirals of the coil of rolled stock 12 on the mandrel 20.

The device 37 comprises two guides 39 and 40, substantially semi-cylindrical in shape, hollow inside and arranged one above the other below the mandrel 20. Each guide 39 and 40 has an inner profile mating with the cylindrical outer surface of the mandrel 20 and pivots on the vertical turret 22 of the stationary structure 23.

The upper guide 39 is provided with a mouth 41 through which the rolled stock 12 is suitable to enter into the inner cavities of the guides 39 and 40 to be guided in the coiling step during the first revolutions of the mandrel 20.

Two hydraulic actuators 42 and 43 are suitable to simultaneously command the movement of the guides 39 and respectively 40 to take them from a substantially vertical working position (FIG. 2), wherein they are arranged around the mandrel 20 to guide the rolled stock 12, to a substantially horizontal inactive position (FIG. 3), wherein they are distant from the mandrel 20 and outside the space occupied by the coil which is forming on the mandrel 20 itself.

All the parts which come into contact with the rolled stock 12, like the elements 25 of the mandrel 20, the inner wall 24, the cylindrical plate 29 and the guides 39 and 40, are made of wear-resistant materials.

The coiling machine 10 also comprises a device to distribute the spirals 45 (FIG. 1), arranged between the looper 15 and the mandrel 20.

The distributor 45 comprises a tubular guide 46, about 5.5 meters long and with one end 47 pivoting on the base and one end 48 mounted on a distribution trolley 49 which is movable horizontally, commanded by an electric motor which is not shown in the drawings.

In the inactive position the tubular guide 46 lies on a plane substantially tangent to the outer cylindrical surface of the mandrel 20.

The end 48 of the guide 46 is also movable vertically on the trolley 49 so that it can pass from one ring of spirals to the following one with a larger diameter and thus perform the increase in diameter step within the same coiling cycle. A balancing device of a pneumatic type, which is not shown in the drawings, is connected to the end 48 of the guide 46 to facilitate the increase in diameter step and the variation thereof during coiling.

A coil-handling assembly 50 is associated with the mandrel 20 and is suitable to remove the coil of rolled stock 12 as soon as it is formed around the mandrel 20 and to position it on an assembly 51 to transport the coil, located downstream thereof.

The coil-handling assembly 50 comprises a supporting frame 52, on which four idler rollers 53 are rotatably assembled, parallel to each other, to contain the spirals of the coil; they are suitable to cooperate with the trailing end of the rolled stock 12 during the final step as it is coiled onto the mandrel 20.

The coiling machine as described heretofore functions as follows:

In the initial working position the coiling machine 10 is pre-arranged to receive the rolled stock 12 which is to be coiled. To be more exact, the cylindrical plate 29 is positioned in contact with the outer end of the mandrel 20 (FIG. 2) and the semi-cylindrical guides 39 and 40 are arranged in a vertical position, around the mandrel 20.

The mandrel 20 and with it the cylindrical plate 29 are made to rotate by the motor 27 (FIG. 1).

The rolled stock 12 arriving from the rolling train 11 is drawn by the drawing rollers 13 at a very high speed, more than 40 meters per second, towards the coiling machine 10 and the device 45 to distribute the spirals guides the leading end of the rolled stock 12 towards the mouth 41 of the guide 39.

The inner cavities of the guides 39 and 40 facilitate the formation of the first two or three spirals on the mandrel 20, after which the actuators 42 and 43 are activated and the guides 39 and 40 move away from the mandrel 20, rotating by about 90°.

The rollers 13 of the looper 15 guarantee that the rolled stock 12 is kept under tension and that it is coiled under traction onto the mandrel 20 of the coiling machine 10. They also form the loop needed to accumulate rolled stock 12 to be supplied quickly to the coiling machine 10 as the diameters of the coil are increased during the same coiling cycle. The drawing rollers 13 brake the trailing end of the rolled stock 12, to keep it at the desired tension when the mandrel 20 decelerates and stops at the end of the coiling step.

The rolled stock 12 is then guided by the tubular guide 46 which is displaced horizontally, backwards and forwards by the trolley 49 and upwards at the end of every ring of spirals. It is thus possible to obtain a rational and controlled distribution of the spirals both on every single ring and also on the different coaxial rings which form the coil.

With every ring of spirals the mandrel 20 is made to rotate by the motor 27 at a speed temporarily below that of the drawing rollers 13 of the looper 15. The rolled stock 12 is released by the looper 15 at the moment when one ring of spirals is completed and the subsequent ring is started. At this moment the peripheral coiling speed increases in ratio to the change of diameter and the motor 27 adapts its angular speed.

The speed of rotation of the mandrel 20 is controlled by the loop formed by the looper 15, by means of a rotary probe and the motor 27 is torque controlled, and therefore guarantees at every moment the desired coiling traction, irrespective of the speed of the rolled stock 12.

Layer after layer, or ring after ring, the coil is formed until the rolled stock 12 has been completely coiled.

The shears 16 is commanded to shear to size the rolled stock 12 which is coiling on the coiling machine 10, in such a way that the dimensions and weight of the coil are predefined.

While the last spirals are forming, the motor 27 is rapidly decelerated, so that the mandrel 20 stops in a very short time.

During this deceleration step, when the speed of rotation is low and before the trailing end of the rolled stock 12 emerges from the rollers of the drawing assembly 13 located upstream of the spiral distributor 45, the cylindrical plate 29 is distanced from the mandrel 20 by the actuation organ 33 and the handling assembly 50 is taken towards the mandrel 20, with its four idler rollers 53 coaxial to the coil which is just being completed.

The rollers 53 close on the rotating coil and thus prevent the last spirals of the coil from unravelling. In this way the rollers 53 also collaborate in the final step of coiling the trailing end of the compact coil.

When the motor 27 has completely stopped and the coil of rolled stock 12 is stationary, the coil is removed horizontally from the mandrel 20, which at the same time is radially retracted, commanded by the mechanism 37.

It is obvious that modifications and additions may be made to the coiling machine for rolled stock as described heretofore, but these shall remain nonetheless within the spirit and scope of the invention.

What is claimed is:

1. A coiling machine for rolled stock located downstream of a rolling train (11), comprising;

(i) a stationary structure (23);

(ii) a mandrel (20) cantilever mounted on the stationary structure (23) and rotatable around an axis of rotation (21), the mandrel comprising a cylindrical surface having an outer end, and a first lateral wall (24) orthogonal to the axis of rotation (21); and a containing plate (29) pivotally mounted on the stationary structure (23) for being movable between a working position, wherein the containing plate (29) is arranged substantially orthogonal to the axis of rotation so as to define a second lateral wall parallel to the first lateral (24) wall, to allow the coil of rolled stock (12) to be formed, and an inactive position, wherein the containing plate (29) is lowered with respect to the mandrel so as to allow the coil of rolled stock (12) to be axially removed from the outer end of the cylindrical surface of the mandrel (20).

2. The coiling machine as in claim 1, wherein the mandrel comprises a plurality of elements arranged so as to form a cylindrical surface and radially retractable towards the said axis of rotation to facilitate the removal of the just-formed coil of rolled stock.

3. The coiling machine as in claim 2, further comprising a hydraulically commanded and water cooled mechanism, wherein the mandrel comprises retractable elements adapted to be retracted by the hydraulically commanded and water cooled mechanism.

4. The coiling machine as in claim 2, wherein, the retractable elements, the first lateral wall of the mandrel, and the plate, are all made of wear-resistant materials.

5. The coiling machine as in claim 1, further comprising:

an arm (31), having a first end to which the cylindrical plate is mounted cantilevered and rotatable, and a second end which pivots on the stationary structures; and an actuation organ (33) for commanding the pivoting of the arm.

6. The coiling machine as in claim 1, wherein the outer end of the mandrel is substantially conical in shape and is suitable to be inserted in a corresponding conical central seating of the cylindrical plate, so as to achieve a coupling between the mandrel and the plate, so that the plate rotates together with the mandrel when the plate is in the working position.

7. The coiling machine as in claim 1, further comprising an electric motor, wherein the mandrel is adapted to be selectively rotated by the electric motor by including a reduction unit with gears with helical teeth with an appropriate ratio for high speeds.

8. The coiling machine as in claim 1, wherein a device to distribute the spirals is provided to guide the formation of the spirals of rolled stock onto the mandrel, the spiral distributing device comprising a guide organ having at least one end movable on a plane substantially tangent to the outer cylindrical surface of the mandrel.

9. The coiling machine as in claim 1, wherein a coil handling assembly is provided to remove the coil of rolled stock just formed around the mandrel and to position it on a coil transport assembly.

10. The coiling machine as in claim 9, wherein the coil handling assembly comprises a supporting frame on which a plurality of idler rollers are mounted rotatable, parallel to the axis of rotation and suitable to cooperate with the trailing end of the rolled stock during its final phase of coiling onto the mandrel to prevent the spirals of the coil from uncoiling.

11. The coiling machine as in claim 1, wherein a device is provided to facilitate the formation of the first spirals of the coil of rolled stock on the mandrel, the device comprising a first guide and a second guide substantially semi-cylindrical in shape, each guide having an inner cavity, and arranged such that the first guide is above the mandrel and the second guide is below the mandrel, each of the guides having an inner profile mating with the outer cylindrical surface of the mandrel.

12. A coiling machine for rolled stock located downstream of a rolling train, comprising:

a stationary structure;

a mandrel mounted rotary around an axis of rotation on the stationary structure, wherein the mandrel is mounted cantilevered on the stationary structure and comprises an inner wall orthogonal to the axis of rotation and an outer end, and a cylindrical plate suitable to selectively cooperate with the outer end, the cylindrical plate pivotably movable between a working position, wherein the plate is arranged substantially orthogonal to the axis of rotation so as to define a side wall parallel to the inner wall, to allow the coil of rolled stock to form, and an inactive position, wherein the plate is distanced and lowered with respect to the mandrel so as to allow the coil of rolled stock to be axially removed, wherein a device is provided to facilitate the formation of the first spirals of the coil of rolled stock on the mandrel, the device comprising a first guide and a second guide substantially semi-cylindrical in shape, each guide having an inner cavity, and arranged such that the first guide is above the mandrel and the second guide is below the mandrel, each of the guides having an inner profile mating with the outer cylindrical surface of the mandrel.

13. The coiling machine as in claim 12, wherein one of the two guides is provided with a mouth through which the rolled stock is suitable to enter the inner cavities of the guides to be guided as it is coiled during the first revolutions of the mandrel.

14. The coiling machine as in claim 13, wherein two actuators are suitable to simultaneously command the movement of the two guides to take them from a working position substantially orthogonal to the axis of rotation, wherein they are arranged around the mandrel to guide the rolled stock, to an inactive position substantially parallel to the axis of rotation, wherein they are distant from the mandrel and outside the space occupied by the coil of rolled stock.

15. The coiling machine as in claim 13, wherein, the retractable elements, the first lateral wall of the mandrel, the cylindrical plate and the guides, are all made of wear-resistant materials.

16. The coiling machine as in claim 12, wherein two actuators are suitable to simultaneously command the movement of the two guides to take them from a working position substantially orthogonal to the axis of rotation, wherein they are arranged around the mandrel to guide the rolled stock, to an inactive position substantially parallel to the axis of rotation, wherein they are distant from the mandrel and outside the space occupied by the coil of rolled stock.

* * * * *